US005228089A

United States Patent [19]

Inanaga et al.

[11] Patent Number: 5,228,089

[45] Date of Patent: * Jul. 13, 1993

[54] HEARING AID

[75] Inventors: Kiyofumi Inanaga, Kanagawa; Masayoshi Miura, Chiba; Hiroyuki Sogawa, Kanagawa; Yasuhiro Iida, Tokyo, all of Japan

[73] Assignee: Sony Corporation, Tokyo, Japan

[ * ] Notice: The portion of the term of this patent subsequent to Jun. 11, 2008 has been disclaimed.

[21] Appl. No.: 640,830

[22] Filed: Jan. 14, 1991

[30] Foreign Application Priority Data

Jan. 12, 1990 [JP] Japan ..... 2-1195[U]

[51] Int. Cl.[5] ..... H04R 25/00

[52] U.S. Cl. ..... 381/69; 381/68; 381/154; 181/148

[58] Field of Search ..... 381/68.6, 68.7, 69, 381/69.1, 68, 154; 73/585; 181/148

[56] References Cited

U.S. PATENT DOCUMENTS 3,209,080 9/1965 Güttner et al. ..... 381/68.7
3,757,769 9/1973 Arguimbau et al. ..... 73/585
3,787,643 1/1974 Nielsen ..... 381/68.6
4,354,065 10/1982 Buettner .
4,727,582 2/1988 de Vries et al. ..... 381/68.7
5,022,486 6/1991 Miura et al. ..... 181/148

FOREIGN PATENT DOCUMENTS 0360517 3/1990 European Pat. Off. .
0416155 3/1991 European Pat. Off. ..... 381/68.7

*Primary Examiner*—Jin F. Ng
*Assistant Examiner*—Huyen D. Le
*Attorney, Agent, or Firm*—Hill, Steadman & Simpson

[57] ABSTRACT

A hearing aid is disclosed in which the outside sound collected by a microphone is amplified and radiated from the earphone unit so as to be conducted to the user's external auditory meatus. The auditory tube is of an inside diameter approximately equal to that of the user's external auditory meatus and has one end arranged as a section for attachment to the user's auricle and the other end arranged as a reflectionless terminal. The earphone unit is mounted on the peripheral surface of the auditory tube with the sound radiating surface facing the inside of the tube.

5 Claims, 1 Drawing Sheet

HEARING AID

BACKGROUND OF THE INVENTION

1. Field of the Invention

This invention relates to a hearing aid.

2. Prior Art

The hearing aid is so designed that outside sounds, such as the voice, are converted by a microphone into electrical signals which are amplified by an amplifier and supplied to an earphone after correction of the frequency characteristics thereof in accordance with the characteristics of the user's auditory sense, and the thus corrected voice output is supplied from the earphone to the user's external auditory meatus.

Most of the prior-art hearing aids are of the separate type consisting of a main body provided with a microphone unit and a earphone section separate from the main body. However, the separate type hearing aids are not in popular use because they are difficult to handle and cannot be used without being noticed by a third person. Recently, with miniaturization of components, brought about with the progress in the production technology, a unitary type hearing aid, in which the microphone unit, earphone unit, amplifier and the storage battery are accommodated in a main body, has been presented to the market.

In general, the hearing aid is attached to the user's auricle, with the earphone stopping up the external auditory meatus. The user of the hearing aid may hear the sound output emanating from the attached earphone unit as the voice by such sound output reaching the tympanic membrane by way of the external auditory meatus and vibrating the tympanic membrane.

Since the conventional hearing aid is attached to the user's auricle, with the earphone stopping up the external auditory meatus, the sound signal reaching the user's tympanic membrane is reflected thereat to return to the earphone unit by way of the external auditory meatus so as to be reflected by the diaphragm or the housing of the earphone unit to proceed again towards the tympanic membrane. In this manner, both the sound directly emanating from the earphone unit and the sound emanating from the earphone unit and reflected by the tympanic membrane and the earphone unit reach the tympanic membrane. With such conventional hearing aid, in which both the sound directly emanating from the earphone unit and the reflected sound reach the user's tympanic membrane, the user may be fatigued as he feels oppressed or as if the sound source were located within his or her own head. In addition, because of the presence of the reflected sound, it has been difficult to carry out a suitable correcting operation for the voice output by an electrical circuit.

On the other hand, the unitary type hearing aid is liable to howling and unstable operation, because the microphone unit and the earphone unit are mounted close to each other. Besides, the outside noise tends to intrude so as to render it difficult for the user to hear the desired sound.

OBJECT AND SUMMARY OF THE INVENTION

It is therefore an object of the present invention to provide a hearing aid whereby the voice output may be corrected in accordance with characteristics of the user's auditory sense.

It is another object of the present invention to provide a hearing aid whereby the user does not feel oppressed or as if the sound source were located within the user's own head.

It is still another object of the present invention to provide a unitary type hearing aid in which the microphone unit and the earphone unit are mounted close to each other, wherein a sufficient margin exists to prevent howling may be assured to provide for a stable operation.

It is yet another object of the present invention to provide a unitary type hearing aid whereby the outside noise does not intrude and the desired sound may be heard easily.

In accordance with the present invention, there is provided a hearing aid comprising an acoustic tube which has an inside diameter about equal to the inside diameter of the user's external auditory meatus, and one end which can be for attached to the user's auricle and its other end arranged as the terminal where no sound reflection will occur, a microphone unit for converting the outside sound into electrical signals, an earphone unit mounted on the peripheral surface of said acoustic tube with its sound radiating surface facing the inside of the acoustic tube, and an amplifier for amplifying electrical signals outputted from said microphone unit and supplying the amplified signals to said earphone unit.

With the hearing aid of the present invention, outside voice sounds are converted by the microphone unit into electrical signals which are amplified by the amplifier and supplied to the earphone unit. The earphone unit transmits the voice output corresponding these electrical signals and hence to the outside voice signals to the external auditory meatus by way of the acoustic tube.

The acoustic tube has an inside diameter which si approximately equal to the diameter of the external auditory meatus and thus functions as an acoustic duct having the same acoustic impedance as that of the external acoustic meatus. On the other hand, since the acoustic tube has one end formed as the attachment section for attaching the hearing aid at the user's auricle and the other end as the terminal free from sound reflection, there is no risk that the sound once reflected by the tympanic membrane will again be reflected towards the tympanic membrane.

In accordance with the present invention, the voice output from the earphone unit is transmitted to the external auditory meatus by way of the acoustic tube, so that the voice output from the earphone unit reaches the tympanic membrane by way of an acoustic duct having a constant acoustic impedance. Since there is no risk that the sound once reflected by the tympanic membrane will be reflected at the terminal of the acoustic tube to be again transmitted to the external auditory meatus, the user feels that the sound source is at a fixed position without feeling oppressed or as if the sound source were within his or her own head. The hearing aid of the present invention has a stable acoustic characteristic and is free from sound reflections, because the acoustic tube is attached at the user's auricle at all times by means of the attachment section at one end of the tube and functions as the acoustic duct which has the same acoustic impedance as that of the external acoustic meatus. The voice output may be corrected in accordance with characteristics of the user's auditory sense by adjusting the amplifier characteristics. In addition, since the earphone unit is mounted within the inside of the acoustic tube, the hearing aid is of the unitary type capable of performing a stable operation with an enlarged howling margin, in which the outside noise may hardly be intruded and solely the desired sound may be heard easily.

DESCRIPTION OF PREFERRED EMBODIMENT

Figure 1:
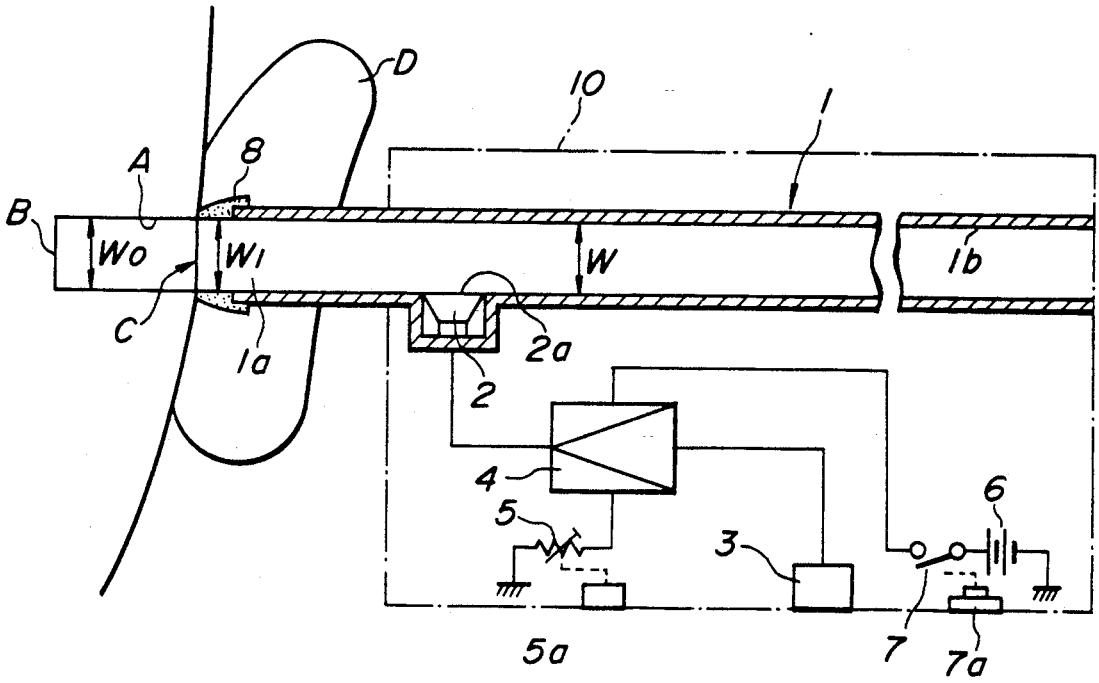
FIG. 1 is a block diagram showing the basic structure of a hearing aid according to the present invention, with an annexed electrical circuit.

By referring to the drawings, a preferred embodiment of the hearing aid according to the present invention will be explained in detail.

Referring to FIG. 1, showing a basic structure of the hearing according to the present invention, the hearing aid shown therein has a main body 10 including an acoustic tube 1, an earphone unit 2 attached to the peripheral surface of the acoustic tube 1 with a sound radiating surface 2*a* thereof facing the inside of the tube 1, a microphone unit 3 for converting outside sound of 1 into electrical signals, and an amplifier 4 for amplifying electrical signals outputted from the microphone unit 3 and supplying the amplified signals to the earphone unit 2.

The main body 10 of the hearing aid is also provided with a variable resistance or adjustment volume 5 for variably setting the characteristics of the amplifier 4 for adjusting the sound quality, an operating knob 5*a* for adjusting the volume, a battery 6 as a driving electrical source, a power source switch 7 and an operating know 7*a* for the switch 7.

Figure 2:
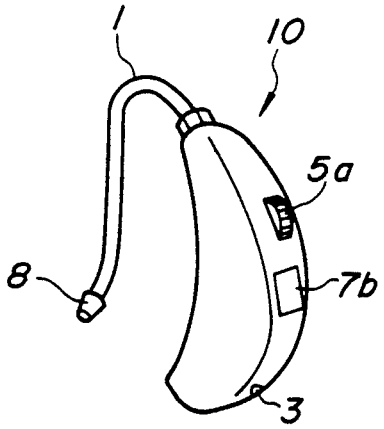
FIG. 2 is a perspective view showing the hearing aid according to the present invention.

Referring to FIG. 2, the acoustic tube 1 may be flexed along the contour of an auricle D so as to function as an ear hanger which is led out from the main body 10 which is arranged at the back of the auricle D.

As shown in the schematic of FIG. 1, the acoustic tube 1 has a uniform inside diameter W which is approximately equal to the inside diameter $W_0$ of the external auditory meatus A. The acoustic tube 1 is in the form of an elongate tube having the uniform inside diameter W, and has one open end 1*a* which is provided with an attachment section 8 for attachment to the auricle D. The other open end 1*b* of which is formed as a terminal where sound reflection is precluded.

The attachment section 8 for attachment to the auricle D is formed as a flexible piece of synthetic resin material which has an end section of reduced thickness which is inserted into and attached to an entrance C of the external auditory meatus A.

The inside diameter $W_1$ of the attachment section 8 is selected so as to be equal to the inside diameter W of the auditory tube 1, that is, approximately equal to the inside diameter $W_0$ of the external auditory meatus A.

The earphone unit 2 is mounted on the acoustic tube 1 with its sound radiating surface 2*a* substantially flush with the inner peripheral surface of the tube 1 and facing the inside of the tube 1. With the sound radiating surface 2*a* substantially flush with the inner peripheral surface of the acoustic tube 1, the earphone unit 2 is mounted on the acoustic tube 1 without the risk of disturbing the acoustic impedance characteristics of the acoustic tube 1.

With the acoustic tube 1 mounted in position, with the foremost part of the attachment section 8 introduced into the entrance C to the external auditory meatus A, the acoustic tube 1 provides a sound duct having a substantially constant inside diameter which extends from a tympanic membrane B in the external auditory meatus A to the opposite opening end 1*b* which a reflectionless terminal of the acoustic tube 1 and thus exhibits a constant acoustic impedance.

Thus the voice output from the earphone unit 2 is not reflected when propagated towards the external auditory meatus A by way of the acoustic tube 1. Also the sound reflected back from the tympanic membrane B when propagated from the external acoustic meatus A towards the acoustic tube 1 is not reflected.

In addition, since the opposite end opening 1*b* of the acoustic tube 1 is a terminal where sound reflection is precluded, it is not possible that the voice output propagated from the earphone unit 2 towards the acoustic tube 1 or the reflected sound which is propagated from the external auditory meatus A to be reflected back at the end opening 1*b*. Hence, it is not possible that sound reflected back by the earphone unit 2 or to be propagated back towards the external auditory meatus A.

With the above described hearing aid, since the reflected sound by the tympanic membrane B is not reflected at the earphone unit 2 back towards the external auditory meatus A, the sense of the location of the sound source is clearer, so that the user will be freezer from fatigue or oppression and will not have the sense of a stationary sound source caused by sound reflections. On the other hand, extremely stable acoustic characteristics may be achieved since the acoustic tube 1 is attached to the user's auricle D in the same manner at all times by means of the attachment section 8 at the one end and it will function as a sound duct with the same acoustic impedance as that of the external acoustic meatus A. Besides, since no sound reflections occur, as mentioned previously, the voice output may be suitably corrected in accordance with the acoustic characteristics of the user's auditory response by operating the adjustment volume 5 to variably set the characteristics of the amplifier 4 and thereby suitably adjust the sound quality. The earphone unit 2 is arranged within the inside of the acoustic tube 1 for improving the howling margin so as to assure stable operation. On the other hand, the desired sound may be heard more easily, inasmuch as outside sound is not deteriorated and a wider dynamic range achieved.

What is claimed is:

1. A hearing aid comprising an acoustic tube having an inside diameter about equal to the inside diameter of the user's external auditory meatus, and having its one end arranged as a section for attachment to the user's auricle and its other end is open, a microphone unit for converting the outside sound into electrical signals and said microphone not directly mounted on a lateral wall of said acoustic tube, an earphone unit mounted on the peripheral surface of said acoustic tube with its sound radiating surface facing the inside of the acoustic tube, and an amplifier for amplifying electrical signals outputted from said microphone unit and supplying the amplified signals to said earphone unit.

2. The hearing aid according to claim 1 wherein the sound radiating surface of said earphone unit is flush with the inner surface of said acoustic tube.

3. The hearing aid according to claim 2 wherein said acoustic tube has a substantially uniform inside diameter from said attachment section to a reflectionless terminal section.

4. The hearing aid according to claim 2 wherein said amplifier may be changed from outside to vary its amplification factor.

5. The hearing aid according to claim 1 wherein said acoustic tube is flexible.

* * * * *